US011140929B2

(12) United States Patent
Carson

(10) Patent No.: US 11,140,929 B2
(45) Date of Patent: Oct. 12, 2021

(54) COOL COMFORT SUIT

(71) Applicant: ABC GLOBAL, LLC., Alexandria, VA (US)

(72) Inventor: Ronald Alphonse Carson, Alexandria, VA (US)

(73) Assignee: COOL COMFORT BY CARSON, LLC, Alexandria, VA (US)

( * ) Notice: Subject to any disclaimer, the term of this patent is extended or adjusted under 35 U.S.C. 154(b) by 0 days.

(21) Appl. No.: 16/266,630

(22) Filed: Feb. 4, 2019

(65) Prior Publication Data

US 2019/0166925 A1 Jun. 6, 2019

Related U.S. Application Data

(62) Division of application No. 14/027,867, filed on Sep. 16, 2013, now Pat. No. 10,194,703.

(Continued)

(51) Int. Cl.
*A41D 1/00* (2018.01)
*A41D 1/02* (2006.01)

(Continued)

(52) U.S. Cl.
CPC ..... *A41D 1/02* (2013.01); *A41D 13/0056* (2013.01); *A41D 31/125* (2019.02)

(58) Field of Classification Search
CPC ..... A41D 1/02; A41D 31/125; A41D 13/0056
See application file for complete search history.

(56) References Cited

U.S. PATENT DOCUMENTS 1,118,792 A 11/1914 Nicholas
1,350,169 A * 8/1920 Mullane ..... A41B 1/00 2/115

(Continued)

FOREIGN PATENT DOCUMENTS

CN 102774090 11/2012
EM 2006089737 A2 8/2006

(Continued)

OTHER PUBLICATIONS

"Anti-Sweat suit promises to make subway more tolerable, www.amny.com", http://www.amny.com/urbanite-1.812039/anti-sweat-suit-promises-to-make-subways-more-tolerable-1.2119995 (Accessed Aug. 25, 2013).

(Continued)

*Primary Examiner* — Richale L Quinn
(74) *Attorney, Agent, or Firm* — Kramer Amado

(57) ABSTRACT

Various exemplary embodiments relate to a business suit. The business suit includes front facing panels and upper sleeve panels formed of a first facing fabric; and an inner lining formed of a second moisture wicking fabric. The suit may further include exterior back panels or lower sleeve panels formed of the second moisture wicking fabric. The suit may further include a sleeve liner interior to a respective upper sleeve panel and the lower sleeve panel, the sleeve liner formed of a third fabric. In various embodiments, the business suit further includes pants. The pants include exterior facing panels formed of the first facing fabric; a waistband formed of the first facing fabric; and a pants liner formed of the second moisture wicking fabric and joined to the waistband. The pants may further include an exterior crotch insert panel formed of the second moisture wicking fabric.

11 Claims, 4 Drawing Sheets

Related U.S. Application Data

(60) Provisional application No. 61/743,872, filed on Sep. 14, 2012.

(51) Int. Cl.
*A41D 13/005* (2006.01)
*A41D 31/12* (2019.01)

(56) References Cited

U.S. PATENT DOCUMENTS 1,599,018 A * 9/1926 Joseph ..... A41D 1/02 2/93
1,973,419 A * 9/1934 Trageser ..... A41D 27/10 2/93
2,391,535 A * 12/1945 Zelano ..... A41D 27/28 2/93
2,438,171 A * 3/1948 Jamieson ..... A41D 1/02 2/93
2,441,122 A * 5/1948 Sturz ..... A41D 1/02 2/97
2,971,199 A * 2/1961 Kozobarich ..... A41D 1/02 2/93
3,086,215 A * 4/1963 Di Paola ..... A41D 27/28 2/93
3,296,626 A * 1/1967 Ludwikowski ..... A41D 27/28 2/87
3,639,914 A * 2/1972 Ellman ..... A41D 1/02 2/93
3,761,962 A * 10/1973 Myers ..... A41D 27/28 2/79
3,812,540 A * 5/1974 Pagano ..... A41D 1/02 2/93
3,829,901 A * 8/1974 Massetti ..... A41D 1/02 2/97
4,608,715 A * 9/1986 Miller ..... A41D 27/285 2/1
5,010,595 A * 4/1991 Stradley ..... A41D 1/06 2/227
5,105,478 A * 4/1992 Pyc ..... A41D 27/28 2/115
5,526,534 A * 6/1996 Lazar ..... A41D 1/02 112/424
5,669,072 A * 9/1997 Bjorklund ..... A41D 1/02 2/272
5,792,714 A * 8/1998 Schindler ..... A41D 13/005 442/194
6,194,332 B1 2/2001 Rock et al.
6,332,221 B1 * 12/2001 Gracey ..... A41B 9/00 2/69
6,421,831 B1 * 7/2002 Korff ..... A41D 1/00 2/115
6,427,242 B1 * 8/2002 Bush ..... A41D 27/02 2/272
6,839,914 B2 * 1/2005 Shiozaki ..... A41D 1/02 2/227
7,263,726 B2 * 9/2007 Gadot ..... A41D 1/02 2/108
7,437,774 B2 * 10/2008 Baron ..... D03D 9/00 2/69
8,133,824 B2 3/2012 Harber
9,596,896 B2 * 3/2017 Coza ..... A41D 31/102
2003/0066120 A1 * 4/2003 Tremblay-Lutter ..... A62D 5/00 2/164
2003/0084497 A1 * 5/2003 Shiozaki ..... A41D 1/02 2/93
2004/0083516 P1 5/2004 Chigaya
2005/0278824 A1 * 12/2005 Gadot ..... A41D 1/02 2/108
2007/0239106 A1 12/2007 Harber
2007/0293106 A1 * 12/2007 Harber ..... A41D 1/04 442/2
2009/0120349 A1 5/2009 Vanova
2010/0199404 A1 * 8/2010 Garza ..... A41D 3/02 2/84
2012/0144555 A1 6/2012 Panicali
2013/0133353 A1 * 5/2013 Araujo ..... B29C 69/00 62/331
2016/0198778 A1 * 7/2016 Hines ..... C08K 5/07 2/269

FOREIGN PATENT DOCUMENTS

EP 2006092777 A1 9/2006
GB 2430443 * 3/2007 ..... A41D 31/02
JP 2007231490 A 9/2007

OTHER PUBLICATIONS

"International Search Report for PCT/US2013/059944".
"Nike Dri-FIT Flat Front Tech Men's Golf Pants, www.csportsfashion.com," http://www.csportsfashion.com/20101206/hike-dri-fit-flat-front-tech-mens-golf-pants.html (Accessed Aug. 27, 2013).

* cited by examiner

COOL COMFORT SUIT

CROSS-REFERENCE TO RELATED APPLICATIONS

This application is a divisional application of application Ser. No. 14/027,867, filed Sep. 16, 2013, which is hereby incorporated by reference for all purposes This application claims priority to provisional application No. 61/743,872 filed Sep. 14, 2012, which is hereby incorporated by reference for all purposes.

TECHNICAL FIELD

Various exemplary embodiments disclosed herein relate generally to textiles. Various exemplary embodiments relate more specifically to business suits.

BACKGROUND

The key mission of the Secret Service and U.S. Diplomatic Security Service is protection. Agents and officers are specially trained to make sure the President, U.S. cabinet secretaries and others they detail are protected, including in situations that may be dangerous or even life-threatening. Agents and officers may work 20-hour days, spend weeks at a time on the road, and be outside in extreme weather for extended periods. They may be called upon to exert themselves physically while wearing professional attire, at a moment's notice. One of the only logistical functions perhaps outside of their control is maintaining their own comfort and outward professional appearance due to excessive perspiration or heat exposure.

Special Agents of the Secret Service wear attire that is appropriate for the surroundings in order to blend in with crowds and avoid easy detection. In many circumstances, this attire is a conservative business suit that can conceal service pistols and electronic equipment. Not only must the agent deal with heat from the external environment, but he/she must also cope with heat generated within his/her own body as a result of physical exertion or warm climate.

Failure to properly release and move heat away from the body during physical exertion or extended periods in heated environs can cause a dangerous rise in a person's body temperature, potentially resulting in adverse health effects such as heat exhaustion or heat stroke. Likewise, visible sweat stains appear on garments leaving unsightly wet spots that are unprofessional.

Adequate cooling of body temperature is critical to non-federal employees as well. Professionals in the private sector who are required to wear suits for long days of work meetings and site visits may experience sweating and discomfort during business activities. Embarrassing perspiration and discomfort may impede job performance and client confidence, betraying any outward poise or self-assurance. Likewise, people involved in professional and college sports such as coaches and managers may wish to maintain a professional appearance along the sidelines during intense situations in warm environments.

SUMMARY

In view of the foregoing, there is a need for a business suit that may be worn by security agents and other professionals in warm and stressful environments that provides enhanced cooling properties while strictly maintaining a traditional business appearance.

A brief summary of various exemplary embodiments is presented. Some simplifications and omissions may be made in the following summary, which is intended to highlight and introduce some aspects of the various exemplary embodiments, but not to limit the scope of the invention. Detailed descriptions of a preferred exemplary embodiment adequate to allow those of ordinary skill in the art to make and use the inventive concepts will follow in later sections.

Various exemplary embodiments relate to a business suit. The business suit includes front facing panels and upper sleeve panels formed of a first facing fabric; and an inner lining formed of a second moisture wicking fabric.

In various embodiments, the suit further includes exterior back panels formed of the second moisture wicking fabric. The suit may further include an interfacing layer forming a partial border around each back panel, the interfacing layer having a gap adjacent a seam between the back panel and a lower sleeve panel.

In various embodiments, the suit further includes lower sleeve panels joined to the upper sleeve panels, the lower sleeve panels formed from the second moisture wicking fabric. The suit may further include a sleeve liner interior to a respective upper sleeve panel and the lower sleeve panel, the sleeve liner formed of a third fabric. Each lower sleeve panel may form between 30% and 50% of the circumference of the sleeve. Each lower sleeve panel may extend from an armpit to approximately the elbow, and a second lower sleeve panel may be formed from the first facing fabric and extend from approximately the elbow to a cuff.

In various embodiments, the business suit further includes pants. The pants include exterior facing panels formed of the first facing fabric; a waistband formed of the first facing fabric; and a pants liner formed of the second moisture wicking fabric and joined to the waistband. The pants may further include an exterior crotch insert panel formed of the second moisture wicking fabric. The exterior crotch insert panel may be triangular and may extend from a crotch seam of the pants to at least 40% of the length of an inseam of the pants. The exterior crotch insert panel may be in direct contact with the pants liner.

In various embodiments, the moisture wicking fabric is a synthetic blend including spandex. The moisture wicking fabric may further include polyester. The moisture wicking fabric may further include cotton. In various embodiments, the moisture wicking fabric is approximately 62% cotton, 34% polyester, and 4% spandex.

In various embodiments, the moisture wicking fabric is stretchy. The inner lining of the suit jacket may include at least one pocket formed of the moisture wicking fabric.

Various exemplary embodiments relate to a suit jacket. The suit jacket includes: two front facing panels formed of a first facing fabric, the first facing fabric comprising wool; two side facing panels formed of the first facing fabric, each side facing panel seamed to a respective front facing panel; two back panels formed of a second moisture wicking fabric, each back panel seamed to a respective front facing panel at a shoulder, seamed to a respective side panel at an outer edge, and seamed to the other back panel at an inner edge; two upper sleeve panels formed of the first facing fabric, each upper sleeve panel seamed to a respective front facing panel and to a respective back panel at a shoulder; and two lower sleeve panels formed of the second moisture wicking fabric, each lower sleeve panel seamed to a respective upper sleeve panel along each of two edges and seamed to a respective side panel at an armpit.

In various embodiments, the suit jacket further includes: a lining formed for the second moisture wicking fabric, the lining located interior to the facing panels and abutting the front facing panels, the side panels, and the back panels; and two sleeve linings formed of a third fabric, each sleeve lining located interior to the sleeve panels.

Various exemplary embodiments relate to a pair of suit pants. The suit pants include exterior front and back facing panels formed from a first fabric comprising wool; a waistband formed of the first facing fabric; a crotch insert comprising two triangular insert panels formed of a second moisture wicking fabric, the crotch insert seamed along the inseam of the front and back facing panels, and forming the crotch of the suit pants; and a pants liner formed of the second moisture wicking fabric and joined to the waistband.

BRIEF DESCRIPTION OF THE DRAWINGS

In order to better understand various exemplary embodiments, reference is made to the accompanying drawings, wherein.

DETAILED DESCRIPTION

Figure 1A:
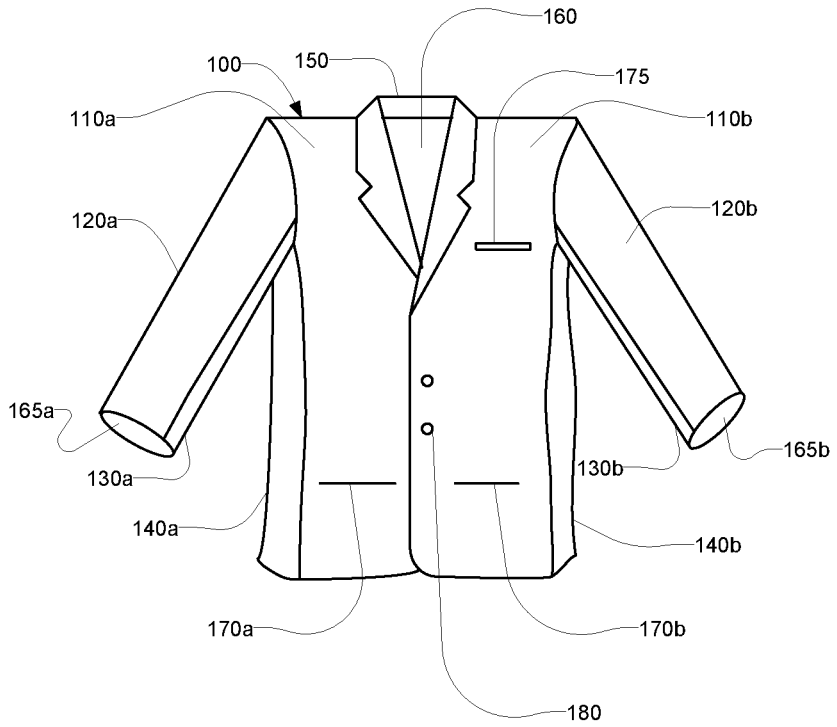
FIG. 1*a* illustrates a front view of an exemplary suit jacket.

Suit jacket 100 may use traditional suit facing materials such as wool, tweed, cashmere, polyester, or linen. Suit jacket 100 may include a moisture wicking fabric for specific panels or components of the suit jacket.

As used herein, the term "moisture wicking fabric" may include any synthetic or synthetic blend fabric designed for pulling moisture away from the body. The term "moisture wicking fabric" specifically excludes fabrics consisting essentially of one of acetate, silk, bemberg silk, rayon, polyester, or cotton. In various embodiments, the moisture wicking fabric may stretch. The moisture wicking fabric may be a synthetic blend including spandex or elastane. Accordingly, the moisture wicking fabric may be stretchy, have four-way stretch, or similar elastic properties. In various embodiments, the moisture wicking fabric may stretch by at least 10%, preferably by at least 20%. In various embodiments, a moisture wicking fabric comprising a blend of cotton, polyester and spandex may be used. In various embodiments, the moisture wicking fabric contains approximately 62% cotton, 34% polyester, and 4% spandex. In another embodiment, the moisture wicking fabric contains approximately 90% polyester and 10% spandex. The exact percentages may be varied to provide desired properties. In another embodiment, the moisture wicking fabric is a blend of polyester, spandex and nylon. Acceptable moisture wicking fabric may be available under the trade names: Dri-FIT, Luon®, Luxtreme®, and UA tech. A moisture wicking fabric may also be available as a generic dri-fit fabric. Such moisture wicking fabric is typically used in athletic apparel.

Referring now to the drawings, in which like numerals refer to like components or steps, there are disclosed broad aspects of various exemplary embodiments.

Figure 1B:
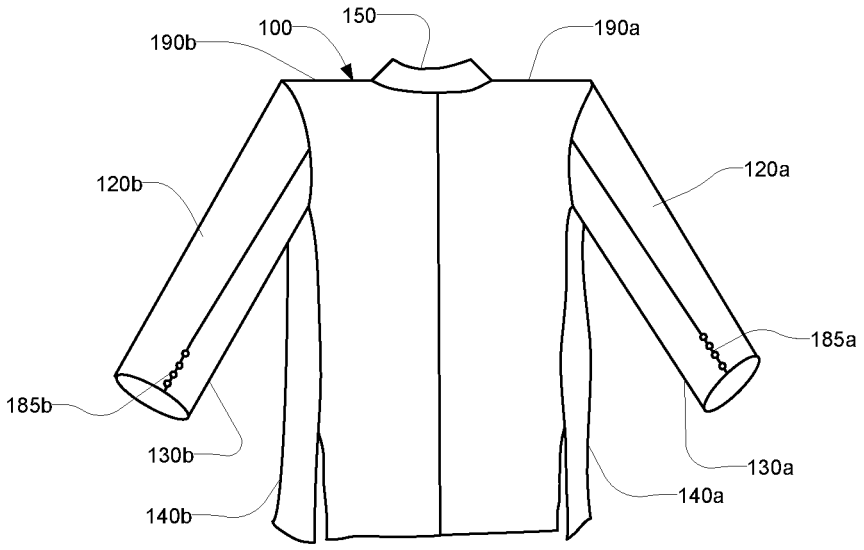
FIG. 1*b* illustrates a back view of an exemplary suit jacket.
Figure 1C:
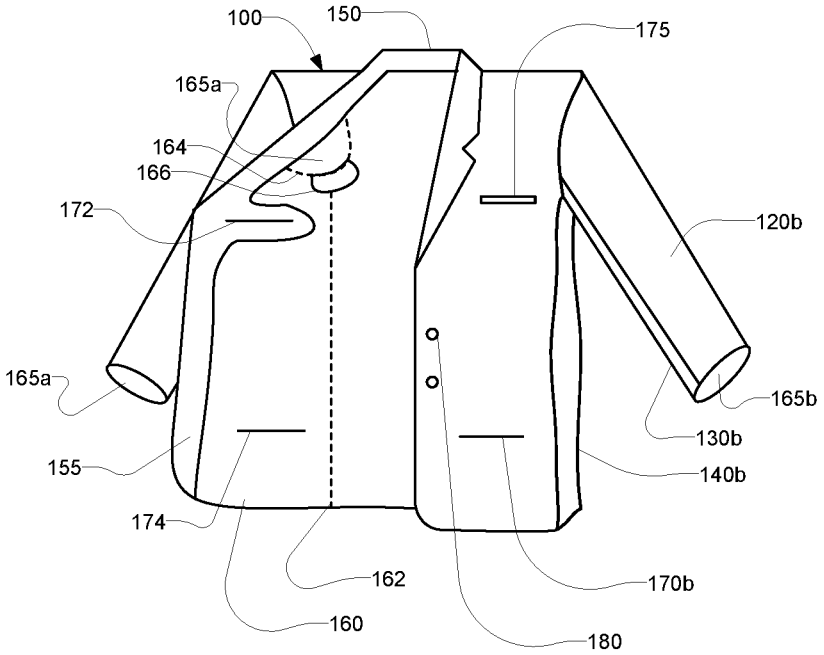
FIG. 1*c* illustrates an open front view of an exemplary suit jacket.

An exemplary suit jacket 100 will not be described with reference to FIGS. 1*a*-1*c*. FIG. 1*a* illustrates a front view of the exemplary suit jacket 100. FIG. 1*b* illustrates a back view of the exemplary suit jacket 100. FIG. 1*c* illustrates an open front view of the exemplary suit jacket 100. Suit jacket 100 may be a formal business suit for business and other formal occasions. Suit jacket 100 may be specifically designed to incorporate moisture wicking materials in such a manner as to provide comfort in warm weather and stressful situations while maintaining a traditional appearance of a business suit.

It should be appreciated that there exists some degree of variation in business suit designs. Accordingly, the exact shape and measurements of the suit components illustrated and described may vary. Moreover, similar principles may be applied to less formal business attire such as blazers and sport coats.

Suit jacket 100 may include left and right front facing panels 110, left and right upper sleeve panels 120, left and right lower sleeve panels 130, left and right side panels 140, collar 150, inner lining 160, left and right sleeve linings 165, left and right front pockets 170, breast pocket 175, buttons 180.

Front facing panels 110 may form the visible front surface of the suit jacket 100. The front facing panels 110 may include a right facing panel 110*a* and a left facing panel 110*b*. Front facing panels 110 may be made from traditional suit facing materials. In various embodiments, the front facing panels 110 are made from wool or a wool blend. Front facing panels 110 may include an interfacing material on the back or wrong side. The interfacing material may strengthen the front facing materials and provide stiffness and proper drape for the suit jacket 100. In various embodiments, traditional interfacing materials such as canvas may be used. In various embodiments, a fusible interfacing material may be used.

Upper sleeve panels 120 may form the visible surface of the upper sleeves of suit jacket 100. The upper sleeve panels 120 may include a left upper sleeve panel 120*a* and a right upper sleeve panel 120*b*. The upper sleeve panels 120 may be made from traditional suit facing materials. The material for the upper sleeve panels 120 may be the same fabric as the front facing panels 110.

Lower sleeve panels 130 may form the visible surface of the lower sleeves of the suit jacket 100. The lower sleeve panels 130 may include a left lower sleeve panel 130*a* and a right lower sleeve panel 130*b*. The lower sleeve panels 130 may be located under the arm and extend from the armpit to the cuff. The lower sleeve panels 130 may be seamed with the upper sleeve panels 120 on one side along a seam aligned with sleeve buttons 185. The lower sleeve panels 130 may be seamed with the upper sleeve panels 120 on the other side along a second seam. The location of the second seam and the relative size of the lower sleeve panels 130 in relation to the upper sleeve panels 130 may be selected to minimize the visibility of the lower sleeve panels 130. In various embodiments, the lower sleeve panels 130 may constitute approximately 40% of the circumference of the sleeves. The size of the lower sleeve panels 130 may vary from approximately 30% to approximately 50% of the circumference of the sleeve. The lower sleeve panels 130 may be formed from a moisture wicking fabric. The color and texture of the moisture wicking fabric may be selected to as closely as possible match the fabric of the front facing panels 110 and upper sleeve panels 120. Being located under the arm, the lower sleeve panels 130 may be in close proximity to the wearer's armpit and help wick moisture away from the armpit. Being an external fabric, the lower sleeve panels 130 may further help evaporate moisture. In various alternative embodiments, the lower sleeve panels 130 may include a first portion formed of moisture wicking fabric and a second portion formed of a traditional facing fabric. In such embodiments, the moisture wicking fabric may extend from the armpit to a point near the elbow. The point near the elbow may include any portion of the sleeve that curves when the wearer's elbow is bent. A patch (not shown) may be placed over a seam between the first portion and the second portion. In various embodiments, the lower sleeve panels 130 may be formed entirely of a traditional facing fabric matching the front facing panels 110.

Side panels 140 may form the visible surface of the sides of suit jacket 100. Side panels 140 may include a left side panel 140*a* and a right side panel 140*b*. The side panels 140 may be made from traditional suit facing materials. The material for the side panels 140 may be the same fabric as the front facing panels 110. In various alternative embodiments, side panels 140 may be made partially of a moisture wicking fabric. In such embodiments, the moisture wicking fabric may extend from the armpit approximately 25% of the length of the side panel.

Collar 150 may form the visible surface on both the interior and exterior of suit jacket 150. Collar 150 may be made from the same traditional facing material as front facing panels 110. Border 155 may be another panel made from the same traditional facing material as front facing panels 110. Border 155 may extend from collar 150 along an edge of the jacket 100. Border 155 may surround inner breast pockets 172 and provide rigidity to improve access to such pockets.

Inner lining 160 may form a major portion of the internal surface of suit jacket 100. In various exemplary embodiments, the inner lining 160 forms approximately 95% of the interior surface of the jacket 100, excluding the sleeves. Inner lining 160 may be formed of one or more panels joined by seams 162. For example, inner lining 160 may include a back panel and two front panels. Inner lining 160 may also include side panels if necessary. Inner lining 160 may be a full inner lining for suit jacket 100. Inner lining 160 may include inner lower pockets 174. Inner lining 160 may be formed of moisture wicking fabric. Inner lining 160 may be in contact with the shirt or skin of the wearer. Being close to the wearer, the moisture wicking fabric of inner lining 160 may help move moisture away from the skin of the wearer. Due to the elastic properties of the inner lining 160, the inner lining 160 may be cut smaller than the corresponding exterior panels. For example, the back panel of inner lining 160 may have approximately 90% of the combined external surface area of external back panels 190.

Sleeve linings 165 may form an inner surface of the sleeves of jacket 100. Sleeve linings 165 may include a right sleeve lining 165*a* and a left sleeve lining 165*b*. Sleeve linings 165 may be formed from a different fabric than inner lining 160. Sleeve linings 165 may be formed from traditional suit jacket lining fabrics such as acetate, silk, bemberg silk, rayon, polyester, or cotton. Sleeve lining 165 may be joined to inner lining 160 at seams 164. A flap 166 may also be joined at seam 164. Flap 166 may be formed from the same material as sleeve lining 165 on one side and the same fabric as front facing panel 110 on the other side. Flap 166 may allow easier motion of the arm and greater durability against wear.

Front pockets 170, breast pocket 175, inner breast pocket 172, and inner lower pockets 174 may all be of known sizes and shapes. The inner surface of each pocket may be formed of the moisture wicking material used for inner lining 160 or a traditional suit lining or pocket fabric. Regardless of the fabric used, the pocket may be isolated from the body by the inner lining 160 of moisture wicking fabric. The elasticity of the moisture wicking fabric may help secure items placed in the pockets against movement.

Back panels 190 may form the visible surface of the back of the suit jacket 100. The back panels 190 may include a left back panel 310*a* and a right back panel 310*b*. The back panels 190 may be seamed with the respective front facing panels 110 at the top, with the respective upper sleeve panels 120 and lower sleeve panels 130, and with the side panels 140. The back panels may be joined to each other along central seam along the inner edge. The jacket 100 may include a single or double vent and back panels 190 may be joined appropriately. The back panels 190 may be formed from a moisture wicking fabric. The color and texture of the moisture wicking fabric may be selected to as closely as possible match the fabric of the front facing panels 110 and upper sleeve panels 120. The moisture wicking fabric may be the same as the moisture wicking fabric of lower sleeve panels 130. Being located along the entire back, the back panels 190 may be in close proximity to the wearer's back and help wick moisture away from the back. Moreover, the large external surface area of back panels 190 may help evaporate moisture drawn from other parts of the body via inner lining 160. In various alternative embodiments, the back panels 190 may be formed of a traditional facing fabric matching the front facing panels 110.

Figure 2:
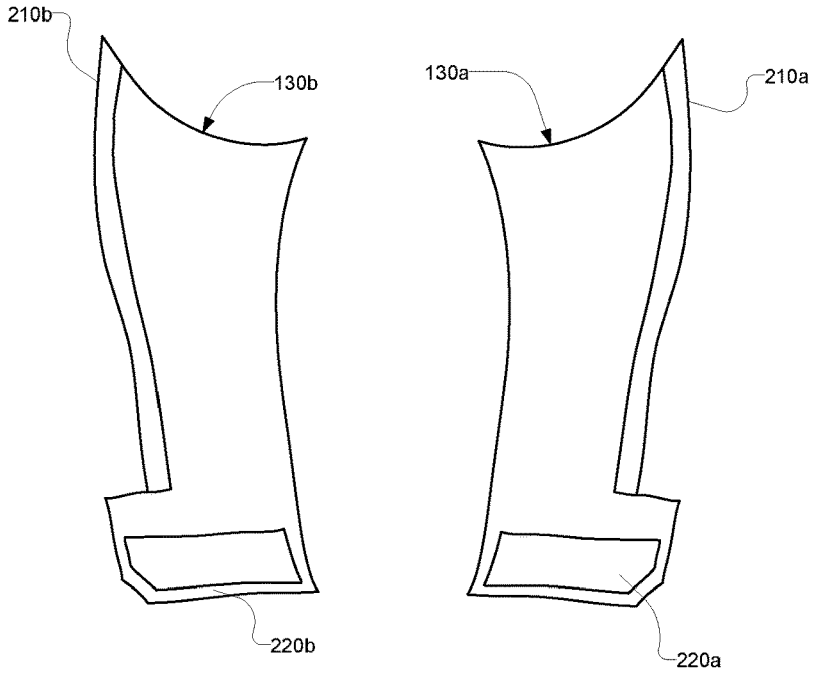
FIG. 2 illustrates exemplary under sleeve panels for a suit jacket.

FIG. 2 illustrates exemplary lower sleeve panels 130 for a suit jacket 100. As discussed above, each lower sleeve panel 130 may form an exterior surface extending from the armpit to the cuff of jacket 100. Each under sleeve panel may have an elongate shape with a curved edge at the armpit. The long edges of the lower sleeve panel 130 may be curved as illustrated, or straight. The cuff portion of the lower sleeve panels 130 may include an extended cuff section for the attachment of sleeve buttons 180. An interfacing material may be attached to lower sleeve panels 130 is strategic locations. A first interfacing section 210 may be located along a first long edge of lower sleeve panel 130 that will be aligned with sleeve buttons 180. A second interfacing section 220 may be located near the cuff and extend into the extended cuff portion. The interfacing may provide strength for seams of the jacket 100 as well as stiffness for proper shape. The interfacing material may be a fusible interfacing material.

Figure 3:
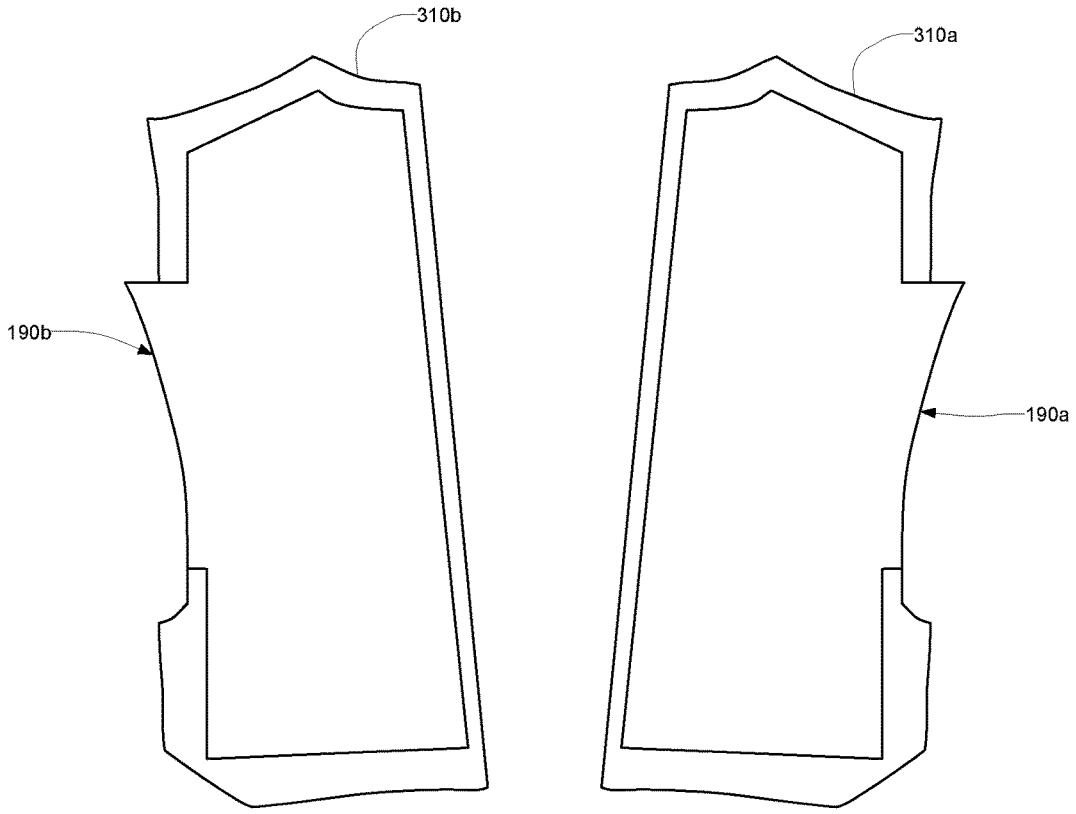
FIG. 3 illustrates exemplary back panels for a suit jacket.

FIG. 3 illustrates exemplary back panels 190 for the suit jacket 100. As discussed above, the back panels 190 may be formed of a moisture wicking material extending across the entire back. Back panels 190 may have the generally straight back panel shape illustrated or may include cutouts or darting for forming a curved back. An interfacing material may be attached to back panels 130 in strategic locations. In particular, a partial border 310 of interfacing material may be attached to the back or wrong side of each of back panels 190. The border 310 may include a gap where the sleeve, in particular, lower sleeve panel 130 is attached. The result may be a seam between two panels of moisture wicking material having no interfacing located near the armpit. Such an interfacing material free seam may provide greater flexibility because the moisture wicking material has more elasticity than traditional facing materials. Moreover, the interfacing material free seam may provide an area with exceptionally good wicking properties at a high moisture area.

Figure 4:
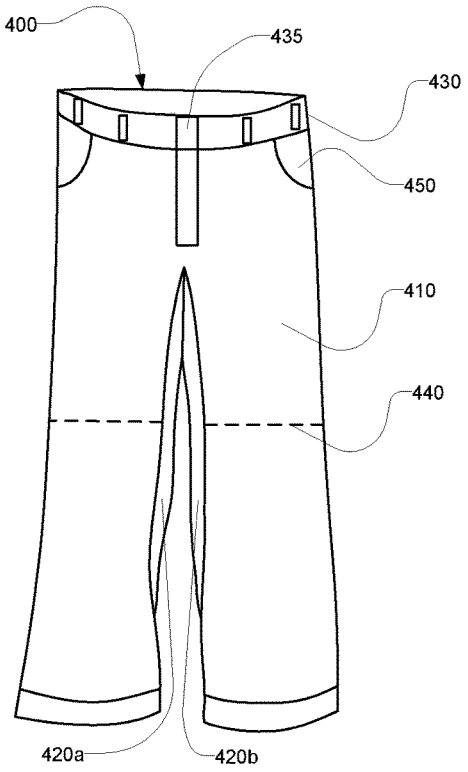
FIG. 4 illustrates a front view of exemplary suit pants.

FIG. 4 illustrates a front view of exemplary suit pants 400. Suit pants 400 may be formal suit pants designed to be worn with suit jacket 100. As such, suit pants 400 may be made from the same materials as suit jacket 100. Suit pants 400 may include facing panels 410, crotch insert panels 420, waistband 430, and fly 435.

Facing panels 410 may form the majority of the exterior surface of suit pants 400. Facing panels 410 may be formed of a traditional suit facing material. In particular, the fabric for facing panels 410 may be the same fabric as the front facing panels 110. Facing panels 410 may include a front facing panel and a back facing panel (not shown) for each side. The facing panels 410 may be seamed together along the sides as in traditional suit pants. The facing panels 410 may also be seamed to crotch insert panels 420 as will be described in further detail below.

Figure 6:
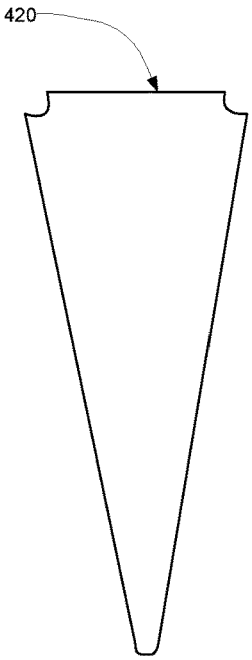
FIG. 6 illustrates an exemplary pants insert panel.

Crotch insert panels 420 may form the exterior surface of the suit pants 400 in the crotch area. FIG. 6, illustrates a detailed view of an exemplary crotch insert panel. Crotch insert panels 420 may include left and right insert panels, which may be mirror images. The crotch insert panels 420 may be generally triangular shaped. The top edge of crotch insert panels 420 may be a curved edge that is sewn to the corresponding panels to form the crotch seam of suit pants 400. The crotch insert panels 420 may extend down along the inseam of suit pants 400. In the illustrated embodiment, the crotch insert panels 420 extend to a point between the knee and cuff. In various alternative embodiments, shorter crotch insert panels may end near or above the knee. The crotch insert panels 420 may extend from approximately 20% of the length of the inseam to approximately 60% the length of the inseam. The crotch insert panels 420 may be formed of moisture wicking material. The moisture wicking material may pull moisture away from the crotch area. The moisture wicking material may also provide greater flexibility of the pants allowing for greater range of movement for the wearer.

Waistband 430 may located at the top of suit pants 400 extending around the waist. Waistband 430 may include standard features such as belt loops, a zipper fly 435 and a closure such as a button, clasp, or hook and eye closure. Waistband 430 may also include an expandable elastic portion or sans-a-belt. Waistband 430 may also be joined with a pants lining 500 at an internal seam.

Figure 5:
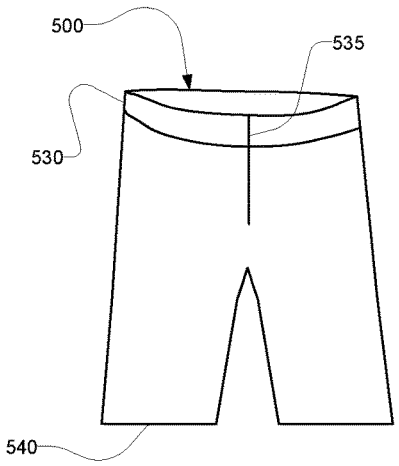
FIG. 5 illustrates a front view of an exemplary pants lining.

FIG. 5 illustrates a front view of an exemplary pants lining 500. Pants lining 500 may include a waistband 530 and fly 535. Waistband 530 may be joined to waistband 430. Pants lining 500 may extend from waistband 530 to lower edge 540. In various embodiments, lower edge 540 is not joined to pants 400. Lower edge 540 may be located approximately above the wearer's knee as shown by line 440. Fly 535 may be joined at each side to fly 435. Pants lining 500 may be formed from a moisture wicking material. Pants lining 500 may be formed from the same fabric as inner lining 160 of jacket 100. Pants lining 500 may contact the underwear or skin of the wearer. Accordingly, pants lining 500 may wick moisture away from the wearer's skin. Pants lining 500 may be in contact with crotch insert 420 such that moisture may travel from pants lining 500 to crotch insert 420.

Although the above embodiments have been illustrated as a men's suit, it should be apparent that the exemplary embodiments may be modified to provide a women's suit. A women's suit may include the same panels as the exemplary suit, but cut for a woman. In various embodiments, the side panels 140 may be omitted. Various embodiments may include a business skirt instead of suit pants. The business skirt may include pants lining 500 seamed at the waistband. Alternatively, the skirt may include a slip formed of the moisture wicking fabric.

According to the foregoing, various exemplary embodiments provide for a business suit having enhanced cooling properties. In particular, by using a moisture wicking fabric as an interior body lining and for specific exterior panels, the traditional look of a business suit may be maintained while maintaining comfort through moisture control and flexibility.

For protective and investigative assignments, agents must carry on their person a standard issue weapon, handcuffs and radio to maintain contact. They also are issued bullet-resistant vests. This equipment drastically increases the weight carried by the person. The additional weight, bulk and resistance resulting from the additional equipment can adversely impact an agent's comfort as well as ability to perform in his duties if he is also uncomfortably warm or sweating. In addition to the moisture control and cooling properties, the exemplary suit helps provide better drape for concealing equipment. The elastic properties of the inner lining may allow the lining to stretch over bulky equipment, helping reduce the movement and noticeable appearance of the equipment under the suit.

Although the various exemplary embodiments have been described in detail with particular reference to certain exemplary aspects thereof, it should be understood that the invention is capable of other embodiments and its details are capable of modifications in various obvious respects. As is readily apparent to those skilled in the art, variations and modifications can be affected while remaining within the spirit and scope of the invention. Accordingly, the foregoing disclosure, description, and figures are for illustrative purposes only and do not in any way limit the invention, which is defined only by the claims.

What is claimed is:

1. A suit jacket comprising:

two front facing panels formed of a first facing fabric, the first facing fabric comprising wool;

two side facing panels formed of the first facing fabric, each side facing panel seamed to a respective front facing panel;

two back panels formed of a second moisture wicking fabric, each back panel seamed to a respective front facing panel at a shoulder, seamed to a respective side panel at an outer edge, and seamed to the other back panel at an inner edge;

two upper sleeve panels formed of the first facing fabric, each upper sleeve panel seamed to a respective front facing panel and to a respective back panel at a shoulder;

two lower sleeve panels formed of the second moisture wicking fabric, each lower sleeve panel seamed to a respective upper sleeve panel along each of two edges and seamed to a respective side panel at an armpit;

a lining formed with the second moisture wicking fabric, the lining located interior to the facing panels and abutting the front facing panels, the side panels, and the back panels; and two sleeve linings formed of a third fabric, each sleeve lining located interior to the sleeve panels.

2. The suit jacket of claim 1, further comprising:

an interfacing layer forming a partial border around each back panel, the interfacing layer having a gap adjacent a seam between the back panels and the lower sleeve panels.

3. The suit jacket of claim 1, further comprising:

a sleeve liner interior to the upper sleeve panels and the lower sleeve panels, the sleeve liner comprising a third fabric.

4. The suit jacket of claim 1, wherein each lower sleeve panel extends from an armpit to approximately the elbow and a second lower sleeve panel comprising the first facing fabric extends from approximately the elbow to a cuff.

5. The suit jacket of claim 1, wherein the second moisture wicking fabric is a synthetic blend comprising spandex.

6. The suit jacket of claim 1, wherein the second moisture wicking fabric further comprises polyester.

7. The suit jacket of claim 1, wherein the second moisture wicking fabric is 62% cotton, 34% polyester, and 4% spandex.

8. The suit jacket of claim 1, further comprising:

a flap formed of the second moisture wicking fabric, wherein the flap is joined to a seam where the lower sleeve panels are joined to the side panels.

9. The suit jacket of claim 6, wherein the flap further comprises:

a first side formed of the first facing fabric and a second side formed of the second moisture wicking fabric.

10. The suit jacket of claim 1, further comprising:

an interior lower pocket with an inner surface formed of the second moisture wicking fabric, wherein the interior lower pocket is inside the one of the front panels.

11. The suit jacket of claim 8, wherein the second moisture wicking fabric is elastic.

* * * * *